US006155643A

United States Patent [19]

Gorgi et al.

[11] Patent Number: 6,155,643

[45] Date of Patent: Dec. 5, 2000

[54] DEVICE FOR ADJUSTING THE HEIGHT OF THE BACK-REST OF A SEAT BACK PORTION, IN PARTICULAR IN OFFICE CHAIRS

[75] Inventors: Claudio Gorgi, Rossano Veneto; Paolo Scagnellato, Padova, both of Italy

[73] Assignee: Imarc S.p.A., Italy

[21] Appl. No.: 09/147,754

[22] PCT Filed: Sep. 4, 1997

[86] PCT No.: PCT/EP97/04800

§ 371 Date: Mar. 2, 1999

§ 102(e) Date: Mar. 2, 1999

[87] PCT Pub. No.: WO98/09553

PCT Pub. Date: Mar. 12, 1998

[30] Foreign Application Priority Data

Sep. 6, 1996 [IT] Italy ..... VE96A0028

[51] Int. Cl.[7] ..... B60N 2/02

[52] U.S. Cl. ..... 297/353

[58] Field of Search ..... 297/338, 353, 297/410, 411.36; 248/161, 157, 407, 408

[56] References Cited

U.S. PATENT DOCUMENTS 4,639,039 1/1987 Donovan .
5,649,741 7/1997 Beggs .
5,685,609 11/1997 Miotto .
5,695,249 12/1997 Lotfi .

FOREIGN PATENT DOCUMENTS 0 210 584 2/1987 European Pat. Off. .
195 17 659 A1 11/1996 Germany .
2 246 287 1/1992 United Kingdom .

*Primary Examiner*—Milton Nelson, Jr.
*Attorney, Agent, or Firm*—Hoffman, Wasson & Gitler

[57] ABSTRACT

A device for adjusting the height of a back-rest of a seat back portion, in particular in office chairs, comprising a guide element rigid with a support plate of a seating portion, a slide for supporting the back-rest, the slide being engagable with the guide element and slidable along it, and means which are elastically selectively engageable with a toothed portion to ensure the stability of the position of the slide relative to said guide.

The elastic means are able to slide freely along the passive flanks of teeth of a toothed portion during the raising of the back rest, and are locked by the active flanks after each passage over a tooth.

13 Claims, 3 Drawing Sheets

17
22
26
21
9
24
23

17
23
9
27

17
9
22

17
22
28
9
25

17
28
21
9

DEVICE FOR ADJUSTING THE HEIGHT OF THE BACK-REST OF A SEAT BACK PORTION, IN PARTICULAR IN OFFICE CHAIRS

FIELD OF THE INVENTION

This invention relates to a device for adjusting the height of the backrest of a seat back portion, in particular in office chairs.

BACKGROUND OF THE INVENTION

Office chairs are known comprising a spoke-type base with feet or wheels, a column mounted on said base and provided with a gas piston for adjusting the height of the sitting plane from the floor, and a seating portion which can be separate from a seat back portion or joined to it and supported by said column.

Generally the seat back portion consists of a pair of tubes which engage telescopically, one tube being rigid with the seating portion and the other tube being provided with a padded back-rest.

A known type of height adjustment device for the back-rest consists of a locking pin rigid with one of the tubes and slidable within a slotted hole provided in the other tube.

In another known device consists of a pin engagable in a hole provided in one tube and engagable elastically in a plurality of superposed holes provided in the other tube.

To another known type of adjustment device, one of the telescopic tubes comprises a plurality of notches in which a rigid tooth element elastically engages.

These known devices have however certain drawbacks, and in particular:

laborious construction due to the large number of components involved, laborious assembly, which is generally effected in the factory and results in a substantial space requirement during transport, laborious operation in adjusting to the desired height, unreliable adjustment as it is related to the distance between the holes.

DESCRIPTION OF THE PRIOR ART

GB-A-2.246.287 discloses a guide element rigid with the support plate of a seating portion, a slide for supporting the back rest and engageable with the guide element and slidable along it, and means rigid with the slide which are engageable elastically and selectively in a toothed portion provided on the guide element.

EP-A-0 210 584 discloses an adjusting mechanism for the step-wise height adjustment of the backrest of a workchair comprising two U-form guide bars embracing side edges of a rectangular support extending up from the seat of a chair.

SUMMARY OF THE INVENTION

An object of the invention is to provide a height adjustment device for the back-rest of a seat back portion, which can be easily and comfortably operated.

A further object of the invention is to provide a device having only a small number of components.

A further object of the invention is to provide a device enabling fine adjustment to be effected.

All these and further objects which will be apparent from the ensuing description are attained according to the invention by a device for adjusting the height of the back-rest of a seat back portion, in particular in office chairs, comprising:

a guide element rigid with a support plate of a seating portion, a slide for supporting said back-rest, said slide being engagable with said guide element and slidable along it, means which are elastically selectively engageable with a toothed portion to ensure the stability of the position of said slide relative to said guide, wherein said elastic means are able to slide freely along the passive flanks of teeth of a toothed portion during the raising of said back rest, and are locked by the active flanks after each passage over a tooth, and in that said elastic means, following their elastic reaction and for a predetermined position of said slide relative to said guide element, are disengagable from said teeth to hence enable said slide to slide by gravity relative to said guide element.

BRIEF DESCRIPTION OF THE DRAWINGS

A preferred embodiment of the present invention and a modification thereof are described in detail hereinafter, with reference to the accompanying drawings, on which.

DESCRIPTION OF PREFERRED EMBODIMENTS

Figure 3:
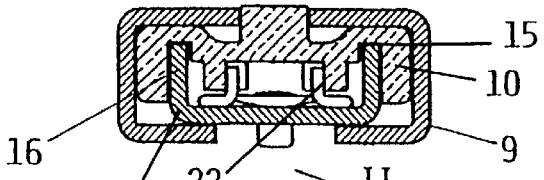
FIG. 3 is a cross-section therethrough on the line III—III of FIG. 1, FIGS. 4–8 are views thereof during adjustment.
Figure 1:
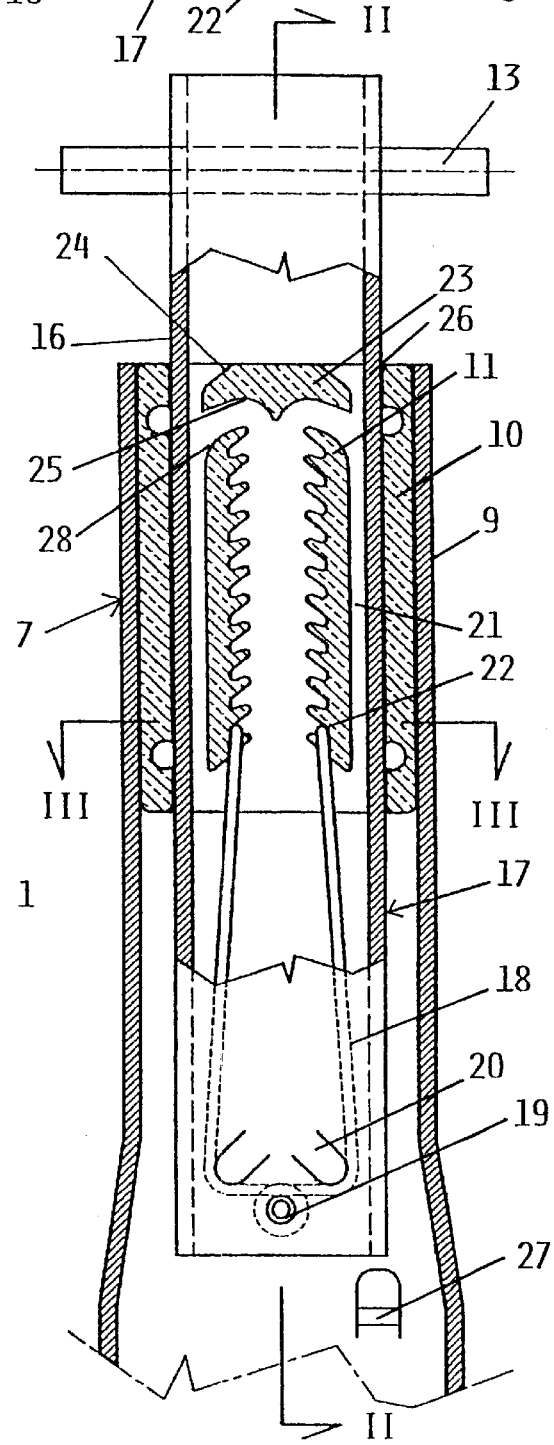
FIG. 1 is a transparent section through the back-rest height adjustment device.
Figure 2:
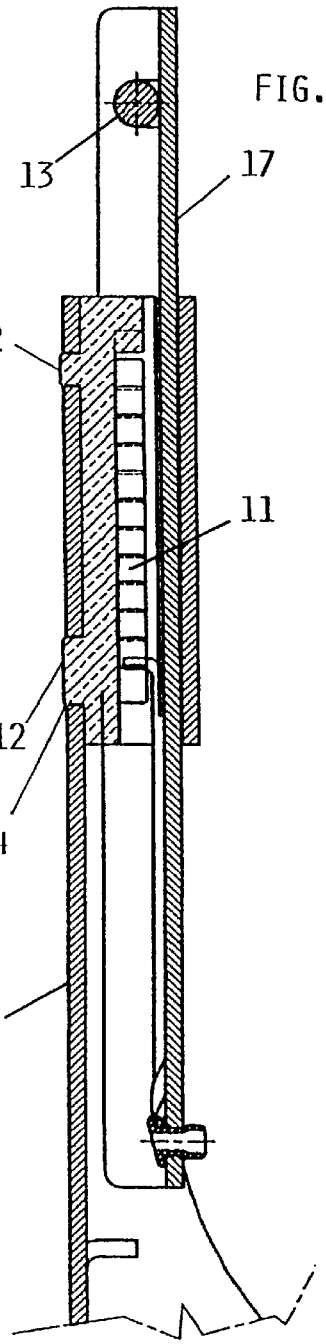
FIG. 2 is a longitudinal section therethrough on the line II—II of FIG. 1.

As can be seen from the figures, the device of the invention is applied to a traditional office chair 1 comprising a spoke-type base 2 with feet 3 or wheels, on column 4 mounted on said base and a support plate 5 for the seating portion 6 and for the support slide 7 for the back-rest 8.

The support slide 7 for the back-rest 8 is formed from a first substantially C-shaped section bar with its flanges bent inwards and internally housing, at its upper end, a plastic insert 10 formed substantially from two mutually facing toothed portions 11 with the tooth cavities inclined upwards.

To ensure secure fixing of the insert 10 this is provided at its rear with two appendices 12 engaging in corresponding holes 14 provided in the surface of said section bar 9.

The insert 10 also comprises two parallel seats 15 in which there are guided the flanges 16 of a substantially U-shaped section bar 17, to the upper end of which the back-rest 8 is fixed by means of a pin 13. To said section bar 17 there is applied a U spring 18, fixed to it by a rivet 19 and by two punched portions 20 of the U-shaped section bar.

The flanges 16 of the U-shaped section bar form with the outer edges of the toothed portions 11 two parallel longitudinal channels 21, the purpose of which will be clarified hereinafter. At its free ends, the U spring 18 is provided with two appendices 22 bent at 90° to the surface of the section bar.

In the absence of external stresses the distance between the spring appendices 22 is less than the distance between the two longitudinal channels 21 and greater than the distance between the ends of the two facing teeth.

In a position overlying said toothed portions 11, the insert comprises a stop element 23 shaped as an isosceles trapezium with oblique sides 24 and with its major base 25 consisting of two arched portions.

Said profiled element 23 has a width greater than the distance between the appendices 22 of the spring 18 when in the unstressed condition, and defines with the flanges 16 of the U shaped section bar two apertures 26 substantially aligned with the longitudinal channels 21.

Figures 4, 5, 6, 7, 8:
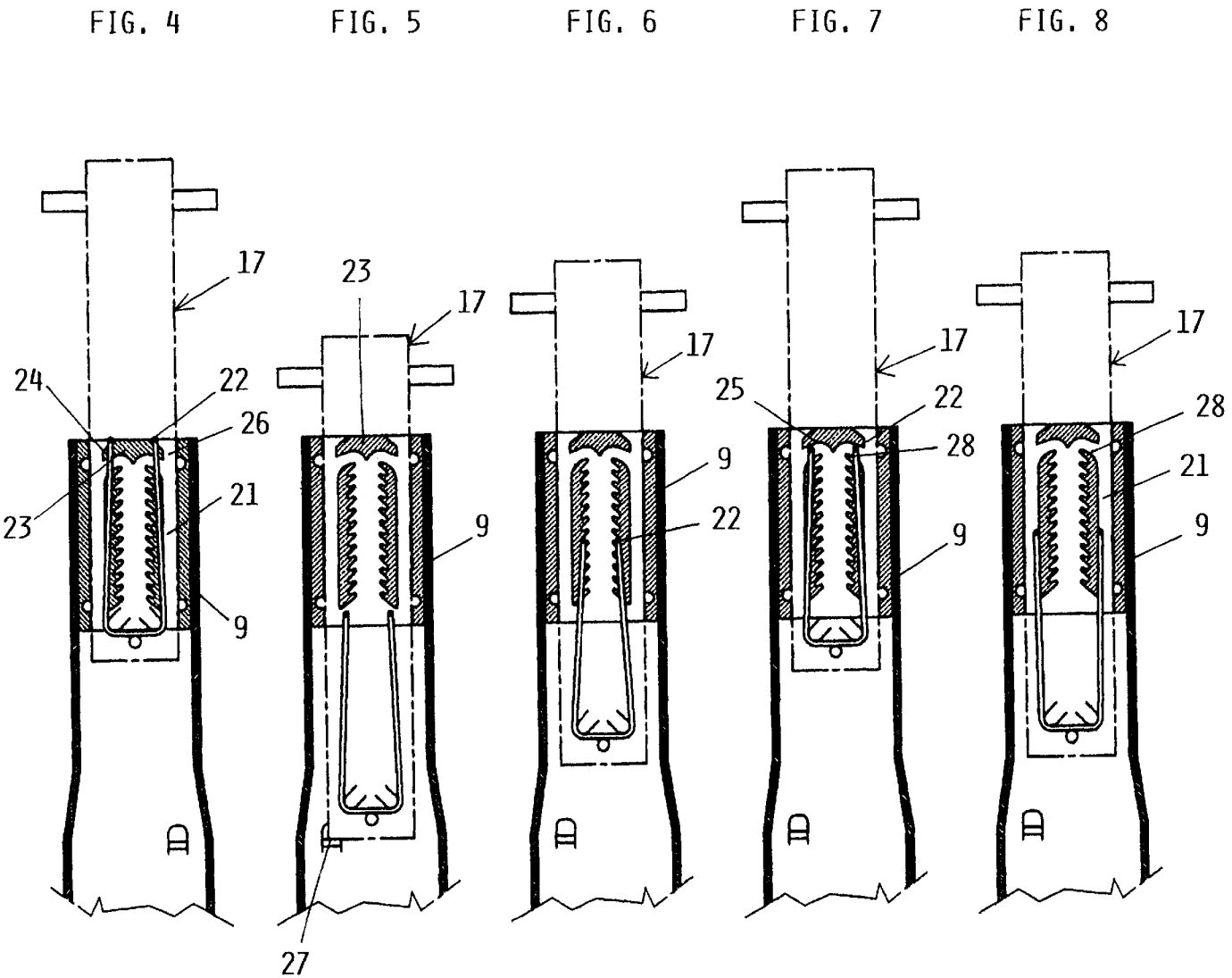
Figure 9:
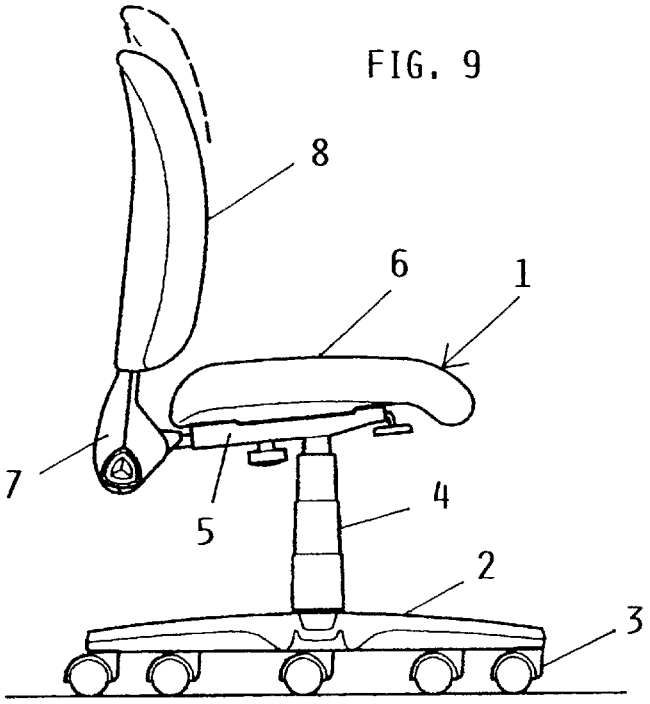
FIG. 9 is a schematic side view of a chair provided with the device according to the invention.

The back-rest adjustment device operates as follows:

the section bar 17 is firstly inserted in the section bar 9 guided by its flanges 16 in the seats 15 of the insert 10. During this stage (see FIG. 4) the appendices 22 engage the oblique sides 24 of the profiled element 23 to become spaced apart so as to be able to pass through the apertures 26 and then be guided to slide along the channels 21.

The travel of the section bar halts when it rests with its lower edge on suitable punched portions 27 provided on the section bar 9. This configuration corresponds to minimum back-rest height above the seating portion (see FIG. 5).

To height-adjust the position of the back-rest 8 the user firstly pulls the section bar 17 upwards to partly withdraw it from the section bar 9.

During this operation the appendices 22 continually pass over the passive flank of each tooth to successively engage in the cavity between two adjacent teeth. Consequently at each advancement the section bar 17 emerges from the section bar 9 by a distance corresponding to the pitch between the teeth (see FIG. 6). This operation is repeated until the user has positioned the back-rest at the desired height.

If this position is too high, to return the back-rest to a lower position the user continues to withdraw the section bar 17 from the section bar 9 until the appendices 22 disengage from the upper teeth and, as a result of the elastic reaction of the spring 18, become spaced apart to interfere with the surface 25 of the element 23 and halt the upward travel of the section bar 17. The user now pushes the section bar 17 into the section bar 9, by which the appendices 22 interact with the curved edge 28 of the toothed portions 11 and are again inserted into the longitudinal channels 21 where they slide freely to enable the section bar 17 to slide along the section bar 9 (see FIG. 8) and hence return to the initial position shown in FIG. 5.

From the aforegoing it is apparent that the adjustment device according to the invention has numerous advantages, and in particular:

it enables fine adjustment to be achieved, based on the pitch of the teeth of the toothed portions, it is of pleasant appearance because of the total elimination of exposed adjustment elements, it enables the position of the back-rest to be adjusted in a simple and comfortable manner, mutual engagement of the section bars 17 and 9 can be achieved easily and quickly, hence reducing the time required for assembly, which can be carried out directly by the final user as the section bar 17 can be already fixed to the back-rest 8.

Figure 10:
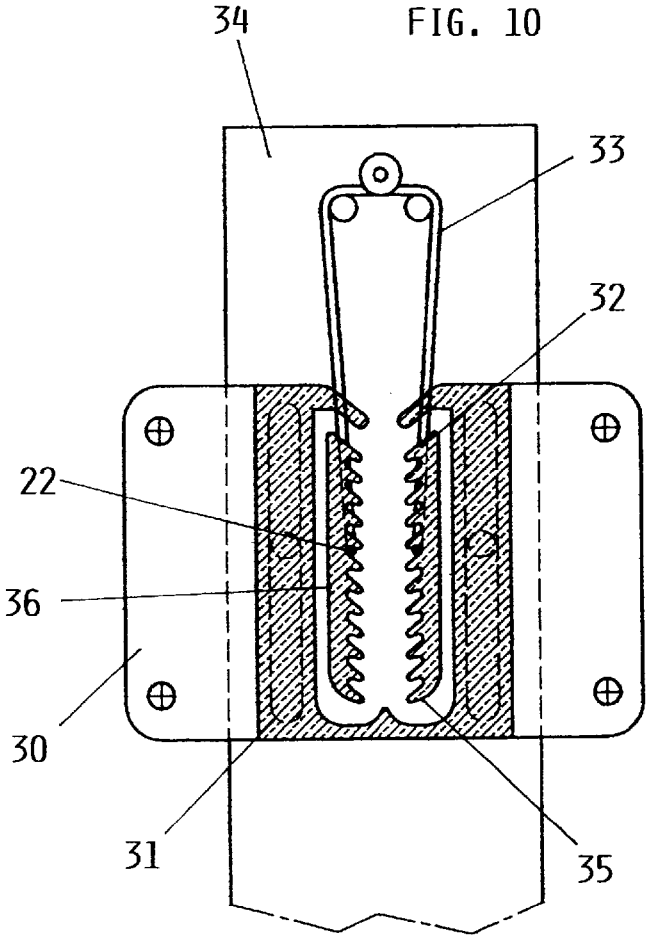
FIG. 10 shows a different embodiment of the device.

In the embodiment shown in FIG. 10 the back-rest 8 is rigid with a plate 30 to which there is applied a profiled insert 31 comprising two toothed portions 32 with the tooth cavities facing each other downwards.

In said toothed portions there engages a spring 33 mounted on a guide 34 fixed lowerly to the support plate for the seating portion.

The operation of the adjustment device of this embodiment is substantially similar to the preceding. In this respect, after the user has engaged the appendices 22 with the upper tooth of the toothed portions (minimum back-rest height configuration), to adjust the position the user pulls the back-rest 8 and consequently the plate 30 upwards, compelling said appendices 22 to pass over the passive flank of the teeth and engage in the active flank of the teeth passed.

When the plate 30 has reached a height such that the appendices 22 are positioned in the lower teeth of the toothed portions, further upward movement of said plate 30 causes the appendices to become spaced apart by virtue of the elastic reaction of the spring 33, and to interact with the curved portion 35 of the insert 31.

Consequently the user can push the back-rest 8 downwards, which because of the free travel of the appendices within the channels 36 can be brought to the configuration corresponding to the lowest position.

What is claimed is:

1. A device for adjusting the height of a back rest of a seat, comprising:

a guide element rigid with a support plate of a seating portion, a slide for supporting said back rest, said slide being engagable with said guide element and slidable along it, at least a rectilinear toothed portion with teeth having an active flank and a passive flank, and an elastic member which is selectively engageable with said teeth of said rectilinear toothed portion;

wherein said rectilinear toothed portion defines a substantially vertical first way for said elastic members which elastically adheres to said rectilinear toothed portion and which slides freely along said passive flanks of said teeth during the raising of said back rest and is locked by said active flanks after each passage over a tooth and a second way parallel to said first way for the free sliding of said elastic member during the descent of said back rest, said first and second ways being spaced by said rectilinear toothed portion and being connected through a pair of passages placed at both ends of said first and second ways and shaped so as to convey said elastic member towards said first way during the rising of the back rest and toward said second way during the descent of said back rest.

2. An adjustment device as claimed in claim 1 wherein said elastic member is rigid with said slide and said rectilinear toothed portion is provided on said guide element.

3. An adjustment device as claimed in claim 1 wherein said elastic member is rigid with said guide element and said rectilinear toothed portion is provided on said slide.

4. An adjustment device as claimed in claim 1, wherein said guide element consists of a C-shaped section bar with its flanges bent inwards and housing internally an insert consisting of two mutually facing toothed portions with tooth cavities inclined upwards.

5. An adjustment device as claimed in 4, wherein said insert comprises two parallel seats in which flanges of said C-shaped section bar are guided.

6. An adjustment device as claimed in 1, wherein said slide consisting of a substantially U-shaped section bar housed within said guide element.

7. An adjustment device as claimed in claim 6, wherein said elastic member consists of a U shaped spring and is applied to said slide.

8. An adjustment device as claimed in claim 7, wherein said U shaped spring is provided at its free ends with two appendices bent at 90° and engaging between the teeth of said rectilinear toothed portion.

9. An adjustment device as claimed in claim 7, wherein said U-shaped spring is fixed by a rivet.

10. An adjustment device as claimed in claim 8, wherein said guide element comprises an element forming a stop surface for said appendices on termination of their travel along the teeth of said toothed portions.

11. An adjustment device as claimed in claim 1, wherein said elastic member consists of a U-shaped spring and is applied to said guide element.

12. An adjustment device as claimed in claim 1, wherein said elastic member is maintained, in absence of external stresses, substantially into touch with a wall of said second way in which said passages come out.

13. A device for adjusting the height of a back rest of a seat, comprising:

a guide element rigid with a support plate of a seating portion, a slide for supporting said back rest, said slide being engagable with said guide element and slidable along it, means for adjusting the mutual position of said guide element and said slide, said means comprising at least a rectilinear toothed portion with teeth having an active flank and a passive flank, and elastic means which are selectively engageable with said teeth of said rectilinear toothed portion;

wherein said rectilinear toothed portion defines a substantially vertical first way for said elastic means which elastically adhere to said rectilinear toothed portion and which slide freely along said passive flanks of said teeth during the raising of said back rest and are locked by said active flanks after each passage over a tooth and a second way parallel to said first way for the free sliding of said elastic means during the descent of said back rest, said first and second ways being spaced by said rectilinear toothed portion and being connected through a pair of passages placed at both ends of said first and second ways and shaped so as to convey said elastic means towards said first way during the rising of the back rest and toward said second way during the descent of said back rest.

* * * * *